United States Patent [19]

Penman

[11] 4,290,381

[45] Sep. 22, 1981

[54] FLOATING MARINA

[76] Inventor: Dexter D. Penman, 9091 Orangewood Ave., Garden Grove, Calif. 92641

[21] Appl. No.: 970,928

[22] Filed: Dec. 19, 1978

[51] Int. Cl.[3] ..... E02D 29/00

[52] U.S. Cl. ..... 114/263; 114/265; 114/294; 405/219

[58] Field of Search ..... 114/264, 266, 267, 263, 114/258, 293, 294; 14/27; 405/219, 224; 9/8 P

[56] References Cited

U.S. PATENT DOCUMENTS

| | | | |
|---|---|---|---|
| 2,908,141 | 10/1959 | Marsh, Jr. | 114/293 X |
| 3,086,368 | 4/1963 | Popper | 405/224 |
| 3,455,115 | 7/1969 | Watts et al. | 405/219 |
| 3,643,448 | 2/1972 | Bower | 405/219 |
| 3,672,178 | 6/1972 | Trautwein | 114/263 X |
| 3,977,344 | 8/1976 | Holford | 114/263 |
| 4,155,673 | 5/1979 | Yashima | 114/293 X |

FOREIGN PATENT DOCUMENTS

| | | | |
|---|---|---|---|
| 2009585 | 10/1971 | Fed. Rep. of Germany | 114/267 |
| 1327924 | 4/1962 | France | 405/224 |
| 300370 | 9/1965 | Netherlands | 114/263 |
| 1462401 | 1/1977 | United Kingdom | 114/264 |

*Primary Examiner*—Douglas C. Butler
*Attorney, Agent, or Firm*—Philip M. Hinderstein

[57] ABSTRACT

A semi-rigid floating marina adapted for use in both ocean and inland waterways including a submerged structural frame interconnected to a floating surface structure by a plurality of rigid and flexible members. The marina is readily portable in nature to accommodate the changing water level and varying boundaries of inland waterways. A variable buoyancy anchor and an in-situ method of forming the same is provided which allows the anchor to be selectively submerged or buoyed from the bottom of the waterway.

21 Claims, 12 Drawing Figures

Fig. 3
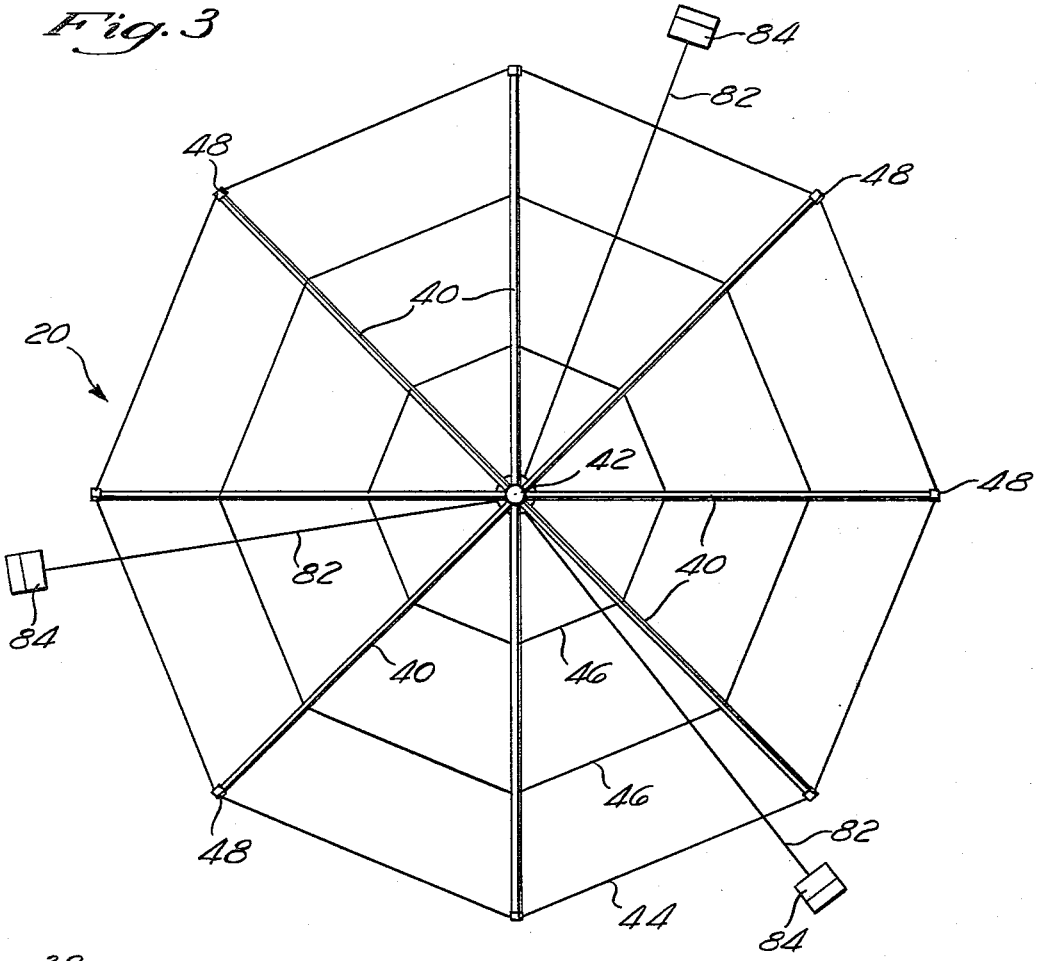
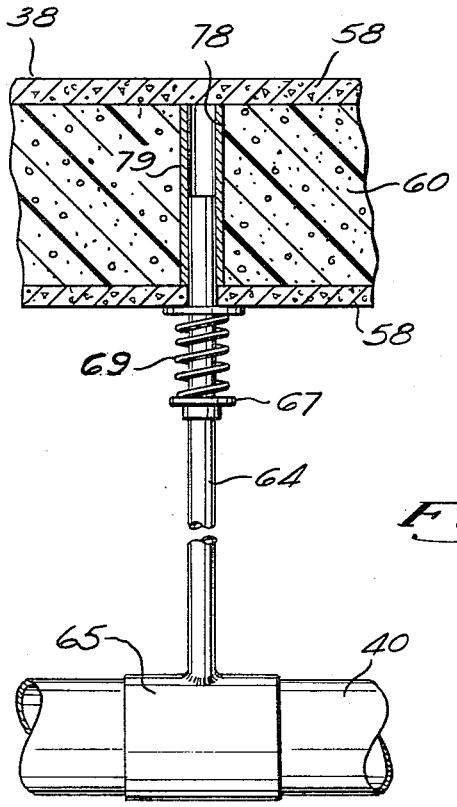
Fig. 5

Fig. 9
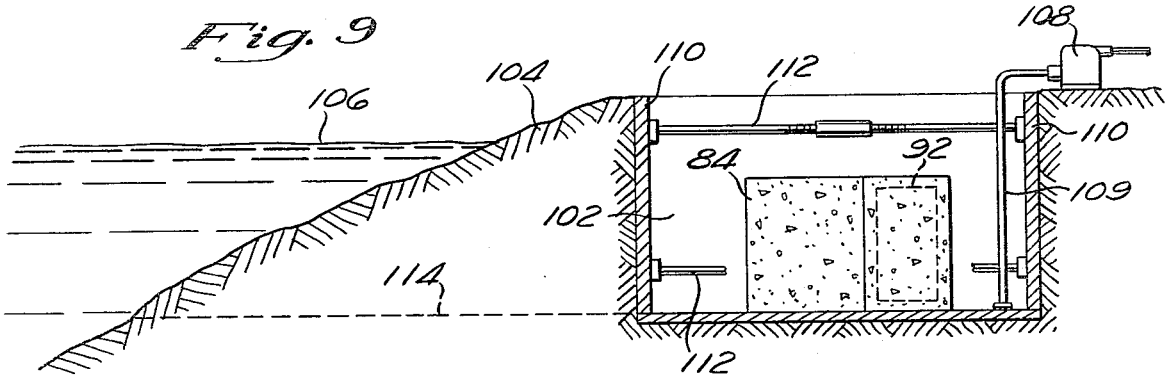
Fig. 10
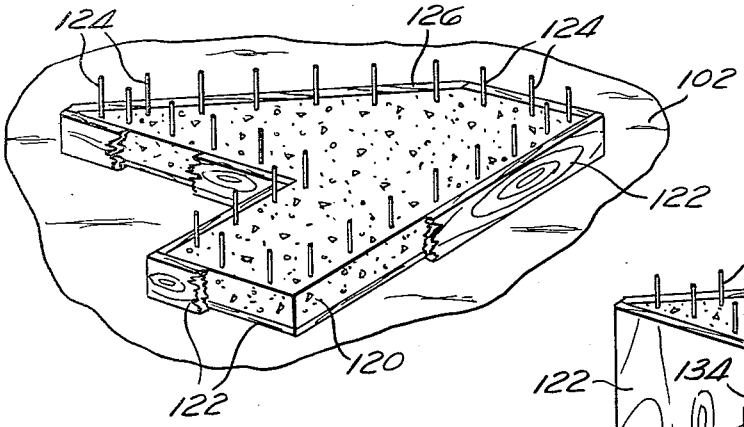
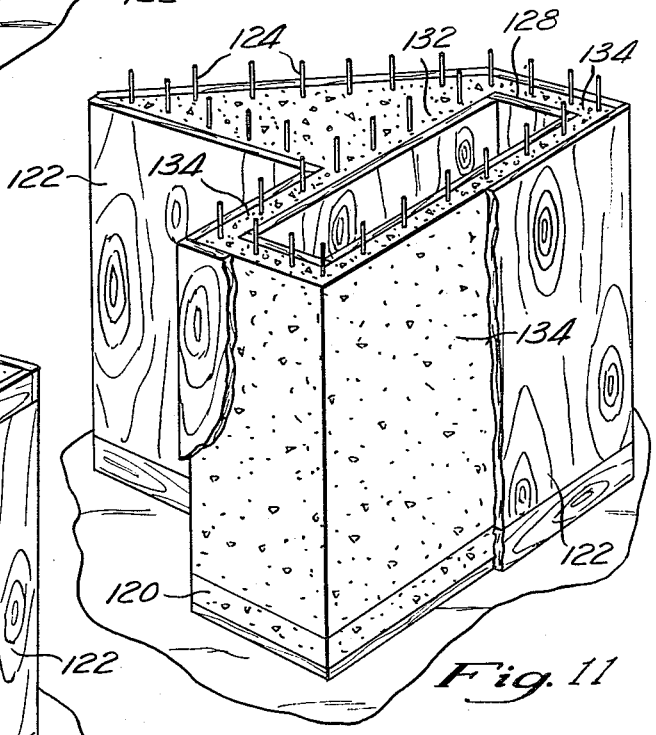
Fig. 11
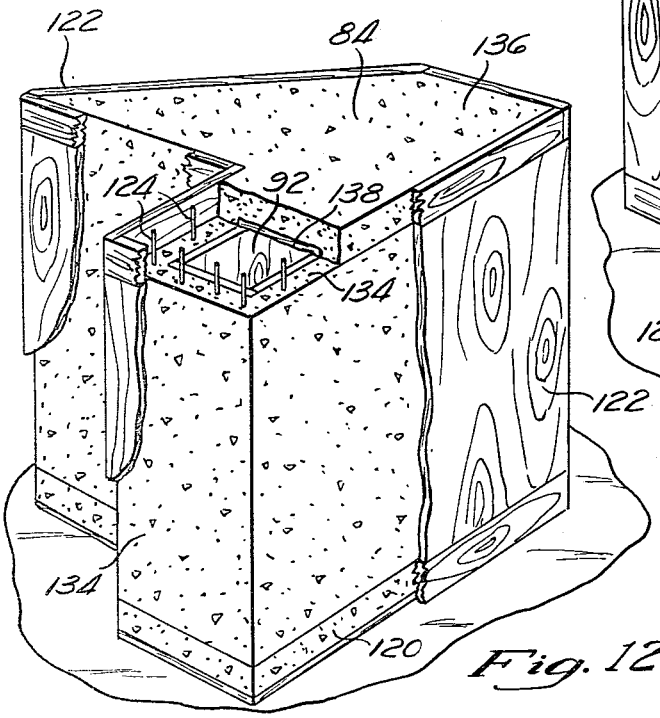
Fig. 12

FLOATING MARINA

BACKGROUND OF THE INVENTION

The present invention relates to floating boat marinas and, more particularly, to floating marinas particularly suitable for use on inland lakes, rivers, and waterways.

In recent years, there has been a dramatic increase in water sport activity and a substantial demand for recreational boats and boating apparatus. This increasing demand has necessitated a corresponding increase in boat moorings and boat marinas along the coastlines and inland waterways. Modernly, there are two types of floating marinas in general use, the ocean marina and the inland marina.

The ocean marinas found along the coastline are usually protected by a natural harbor or a man-made breakwater which shields the marina from the heavy ocean swells. Since the ocean provides a substantially constant sized body of water, the ocean marinas may be permanently located adjacent the shoreline and need only accommodate the vertical movement caused by the incoming and outgoing tidal flow.

As such, ocean marinas are typically formed from a plurality of interconnected floats or pontoons which span between a series of stationary vertical pilings located a short distance offshore. These pilings, which rise to a height substantially above the waterline, cooperate with cut-outs or enlarged apertures formed in the floats, whereby the floats may rise and fall along the length of the pilings in response to the tidal movement, yet be positively maintained in their lateral orientation with respect to the shoreline. Thus, since the floats or pontoons are securely maintained between the stationary vertical pilings, the ocean marina provides a substantially rigid structure having sufficient structural integrity to withstand the current, wind, and tidal forces of the environment.

In contrast to the ocean marinas, the inland marinas are typically disposed in a waterway without the benefit of a breakwater, and must not only accommodate vertical differences in water level but must additionally compensate for substantial boundary or shoreline changes of the waterway.

As will be recognized, the inland waterways, such as rivers and lakes, are subject to extreme long range changes in water level caused by drought or flood conditions wherein the water level, as well as shoreline location, varies substantially throughout the seasons of the year. In particular inland locations where the shoreline gradually drops off into the waterway, these shoreline changes present significant problems, since minor water level changes often cause grounding of boats moored on the inland side of a marina. As such, many inland marinas must be portable in nature to accommodate the changing boundaries of the waterways.

Heretofore, inland marinas have typically utilized a series of floats or pontoons hinged together to form a plurality of boat slips and anchored to the lake bed or river bottom. However, to provide for the lateral movement or portability necessitated by the variances in the water boundaries, the floats are often attached by mooring lines to a series of primary cables layed outward from the shoreline and submerged adjacent the river or lake bottom. Typically, these primary cables are rigidly attached at opposite ends thereof to large anchors and are arranged in a parallel manner such that the floats may be oriented perpendicular thereto, and maintained taut between adjacent primary cables.

With such an arrangement, upon encountering substantial variances in the water level wherein the lake or river boundaries increase or decrease, the inland marina may be moved laterally inshore or offshore by lifting the anchors attached at each end of the primay cables and relocating the cables at a desired location. Typically, this relocation process occurs while boats are docked at the marina and must be accomplished in a very careful manner to prevent damage to the boats caused by slack developed in the cables during the relocation process, which slack may allow adjacent slips to contact one another.

Although these prior art inland marinas have proven useful in their limited application, there exists inherent deficiencies associated in their operation and use. To provide a stabile mooring for the inland marina, the anchors connected at opposite ends of the primary cable must be sufficiently large and possess sufficient weight to prevent movement of the cables along the river or lake bed. Additionally, since, as previously mentioned, the inland marinas typically are not protected by a breakwater, these anchors must withstand the current forces of the waterway as well as accommodate the high wind forces applied to the boats docked in the marina. As such, these anchors are typically large cement bodies weighing upwards of 3,000–5,000 pounds and are submerged to a depth of approximately 50 to 100 feet beneath water level.

Due to the extreme weight characteristics of these anchors, the lifting and movement of the anchors during the relocation of the marina present significant transport problems wherein one or more boats adapted with heavy winch mechanisms must lift the anchors from the river bottom. These transport problems become even more acute when the inland marina is a large structure utilizing a plurality of anchors which all must be moved in unison during the transport process.

Additionally, the prior art inland marinas suffer from their inability to provide a rigid marina structure. As will be recognized, since all of the floats or pontoons are connected to the primary cables by elongate mooring lines often extending more than 50 feet beneath water level, the marina is subject to substantial movement caused by slack in the cable lines. As previously mentioned, during high wind or high current conditions, slack developed in the primary or secondary cables often causes adjacent floats to contact or collide with one another, thereby damaging boats docked at the marina. Thus, there exists a substantial need for an inland marina which will provide a stabile mooring structure, yet be readily portable in nature.

SUMMARY OF THE PRESENT INVENTION

The present invention provides a floating marina which may be effectively utilized in both ocean and inland waterway applications, and additionally provides a semi-rigid structure which significantly prevents damage to boats docked in the marina and is adapted to be easily relocated at a desired position in the waterway.

The floating marina of the present invention is basically composed of a plurality of floats or pontoons arranged to form a series of boat slips which are connected to a rigid frame structure submerged below the waterline and disposed concentric beneath the floating structure.

In the preferred embodiment, this rigid frame structure may be submerged below water level at a depth slightly greater than the maximium draft of boats to be docked in the marina and is securely anchored to the river or lake bottom by plural main anchor lines extending from a central hub of the structure. This rigid frame structure provides the strength of the marina and positively maintains the orientation and location of the floating structure without preventing boat entry to the slips themselves, and without limiting the flexibility of the floating structure, which must move somewhat to accommodate swells, boat wakes, etc.

To transport the marina of the present invention in response to major variances in the water level and boundaries of the waterway, the relatively few main anchors which maintain the position of the marina need only be raised from the river or lake bottom with the subsequent towing of the rigid frame structure to a desired location. Further, the marina of the present invention accommodates minor variances in water level in a simple yet effective manner whereby the position of the submerged support frame structure may be adjusted along the length of each of the plural main anchor lines. Thus, even during transportation, the marina's dimensions and arrangement are maintained.

Additionally, to facilitate ease in this transporting process, the present invention includes a novel anchor device which provides sufficient weight to maintain the marina at its desired location, yet may be selectively easily removed or floated from the river bottom.

In the preferred embodiment, these novel anchors are composed of reinforced concrete having a hollow inner cavity which may be alternatively filled with air or flooded with water. When flooded with water, the anchors provide a substantially heavy mass of approximately 50,000 to 80,000 pounds which positively maintains the desired location of the marina. However, when filled with air, the anchors comprise a buoyant member which may be easily removed from the river or lake bottom.

Additionally, the present invention provides an in-situ method of constructing the novel anchor means, and possibly the main marina pontoons, which facilitates easy entry of the anchors or other structures into the waterway, as well as significantly minimizing construction cost.

These and other features of the present invention will become more apparent upon reference to the drawings wherein:

FIG. 3 is a plan view of the rigid frame structure submerged beneath the floating structure of FIG. 2;

FIG. 5 is an enlarged fragmentary sectional view of the floating marina of the present invention illustrating the rigid connection between the floating and submerged frame structures of the marina;

FIG. 9 is an elevational view of the shoreline and waterway illustrating the in-situ method of forming the buoyant anchor of FIG. 8;

FIG. 10 is a perspective view of the buoyant anchor of the present invention illustrating the first steps in the in-situ construction thereof;

FIG. 11 is a perspective view of the anchor of FIG. 8 illustrating the second step in the construction thereof; and FIG. 12 is a perspective view of the anchor of FIG. 8 depicting the final formation step of the anchor of the present invention.

DETAILED DESCRIPTION OF THE PREFERRED EMBODIMENT

Figure 1:
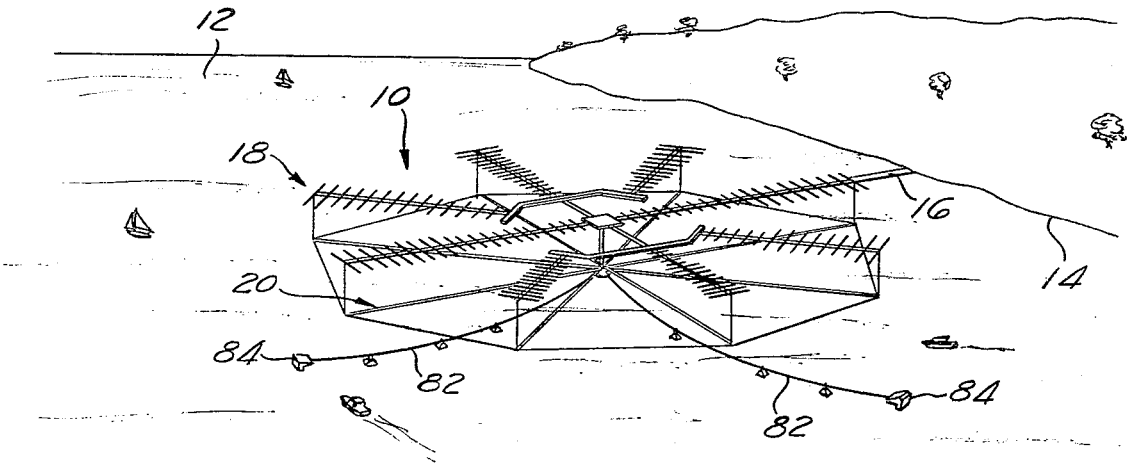
FIG. 1 is a pictorial representation of the marina of the present invention located adjacent the shoreline of an inland waterway illustrating the spacial relationship of the floating structure, support frame, and anchor lines.

Referring to FIG. 1, there is shown a floating marina 10 of the present invention positioned in an inland waterway 12 and located adjacent the shoreline 14. Typically, the marina 10 is maintained approximately 50 to 100 feet from the shoreline 14 and is serviced by a ramp 16 which extends in an angular inclination from the marina 10 to the shoreline 14.

As shown, the marina 10 includes a float structure 18 which resides upon the surface of the waterway 12 as well as a rigid frame structure 20 which is submerged beneath the surface of the waterway 12 and disposed beneath the float structure 18. As will be explained in more detail infra, the float structure 18 and rigid structure 20 are interconnected beneath the surface of the waterway 12 to form a generally co-extensive unit having sufficient structural integrity to withstand heavy water current and wind forces.

The lateral position of the marina 10 from the shoreline 14 is preferably maintained by at least three main anchor cables 82 which extend through a central cylindrical hub formed in the submerged frame structure 20, and are connected at one end thereof to individual winch mechanisms mounted to the float structure 18. Typically each of these anchor cables 82 extend radially outward in a symmetrical pattern from the support structure 20 and is connected at the other end to a respective anchor 84 embedded in the bottom of the waterway 12. In the preferred embodiment, these anchors 84 are formed having an interior cavity which may be selectively filled with water or air to provide a variable buoyancy anchor.

Figure 2:
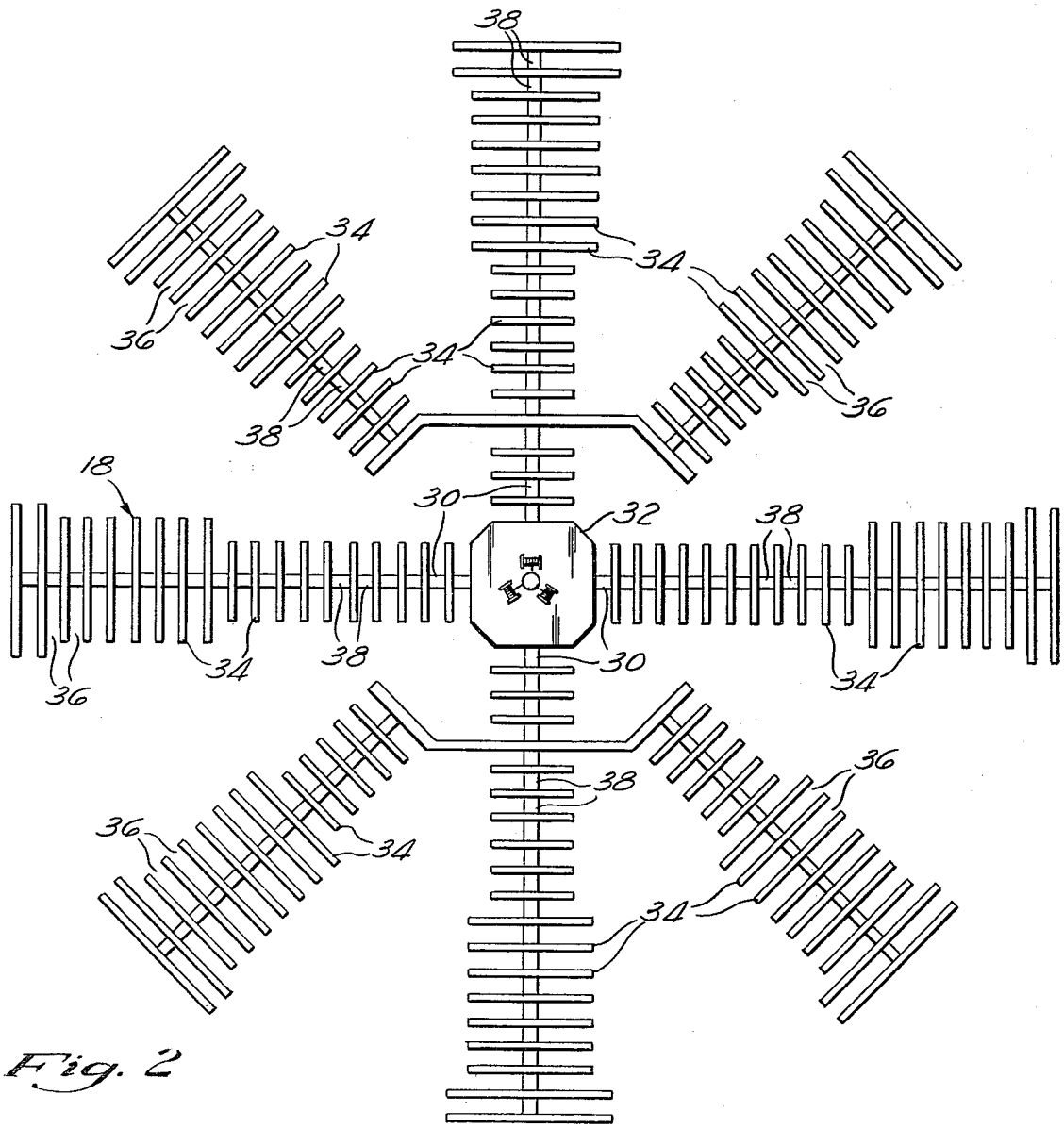
FIG. 2 is a plan view of the floating structure of the marina of the present invention.

Referring to FIG. 2, the detailed construction and configuration of the float structure 18 of the present invention is illustrated. As shown, the float structure 18 is preferably formed in a windmill-like shape, having a plurality of radial members 30 which extend from a central platform 32. Each of the radial members 30 includes a series of elongate floats 34 preferably fabricated of a steel-beam-reinforced foam core covered by a thin layer of concrete, which are arranged in a mutually parallel orientation normal to the length of the radial member 30 to form a plurality of slips 36 for receiving boats (shown in FIG. 1).

Disposed between adjacent elongate floats 34 and typically oriented normal thereto are a series of plate members 38, which are preferably formed from reinforced concrete. As better shown in FIG. 4, these plate members 38 are raised above the surface of the waterway and are supported exclusively adjacent both ends thereof by the top surface of the float segments 34. In the preferred embodiment, the plate members 38 are set or placed upon the float member 34 and are maintained thereto by their own weight and by a cable 35 attached to an underlying cable 50. As such, the plate members are not utilized to maintain the spacing between adjacent float members 34 but rather merely form a common walkway (approximately 3 feet in width) for each of the radial members 30. Thus, as will be recognized, since the plate members 38 are not rigidly attached to the float members 34, limited movement between adjacent elongate floats 34 to absorb minor wave forces is facilitated. In alternate embodiments, the plate members 38 may be wooden or metal spanning structures. If such plates 38 are attached at all to the float members 34, the attachment should be flexible enough to permit substantial relative movement. In addition, care should be taken to avoid pounding impacts between the plates 38 and float members 34, so that wave action does not destroy these elements. For example, shock absorbing padding may be used between these members to protect them.

In the preferred embodiment, the float structure 18 provides an extensive docking marina 10 having an approximate diameter of 600 to 1,000 feet and a docking capacity of 500 to 600 slips. However, the same principles may be utilized for smaller or larger marina structures. Additionally, it should be noted that, although the windmill-like configuration of the preferred embodiment has been found to yield a maximum slip density with high strength, and yet allow sufficient boat access to and from the marina, other configurations are contemplated without departing from the spirit of the present invention. Similarly, although in the preferred embodiment, the elongate floats 34 are formed from a steel reinforced foam core covered with a concrete shell, other materials having sufficient buoyancy, strength, and corrosion resistive properties, such as wood or reinforced cork, are well suited for the present invention.

Referring now to FIG. 3, the detailed construction of the rigid support frame 20 of the present invention may be described. In the preferred embodiment, the support frame 20 is constructed from a plurality of structural pipe members 40 which are commonly joined at one end thereof to a hub or spindle 42 having a tubular riser member 43 extending vertically therefrom (shown in FIG. 4) and rigidly connected thereto by a fillet weld or other well-known fastening means. Each of the pipe members 40 is connected at the other end thereof by a cable 44 which is maintained in tension and forms a perimeter tie for the support frame 20.

As such, the frame 20 is comprised of a series of pre-stressed triangular segments which the applicant has found yields a substantially rigid, two dimensional, planar structure. Additionally, the applicant has discovered that, dependent upon the desired size of the marina 10 or topography of the waterway, the rigidity of the frame 20 may be substantially increased by the addition of one or more intermediate cable ties 46 which extend between adjacent pipe members 40 to eliminate flexing of the pipe members 40 intermediate their length.

The position and length of each of the pipe members 40 of the support frame 20 advantageously corresponds to that of the radial members 30 (as shown in FIG. 1) of the float structure 18, such that the interconnections between the frame 20 and the floating structure 18 may be easily facilitated in a manner described infra. Further, in the preferred embodiment, each of the pipe members 40 is formed of 18-inch diameter steel tubing having a wall thickness of approximately $\frac{1}{2}$ inch and includes an end cap 48 which provides a liquid tight seal for each of the pipe members 40. The applicant has found that this liquid tight seal which forms an air cavity within each of the pipe members 40 permits the support frame 20 to float, or have a neutral buoyancy factor, as desired, which (as will be explained below) facilitates easy submersion and placement of the support frame 20 in the waterway 12.

Figure 4:
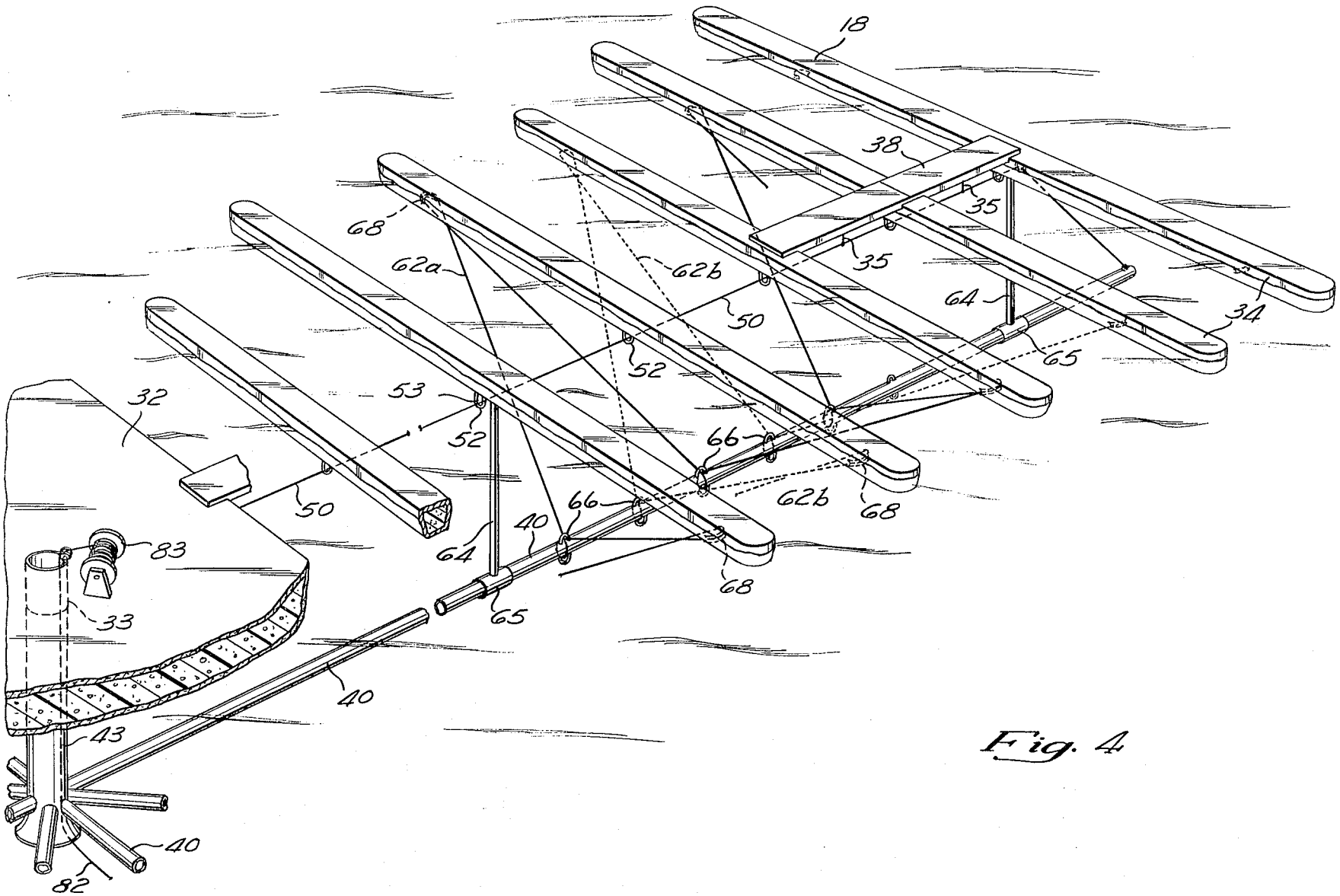
FIG. 4 is a perspective view of a segment of the floating structure and frame structure of the present invention illustrating the particular cable interconnections thereon.

The particular interconnections between the individual segments of the floating structure 18 and the submerged frame structure 20 of the present invention are illustrated in FIG. 4 wherein a portion of the marina structure is depicted positioned on the waterway 12. As shown, each parallel array of elongate floats of the float structure 18 are flexibly interconnected by a cable 50 which extends along the bottom surface of each of the floats 34 and is rigidly connected to the central platform 32 of the float structure 18.

The cable 50 is preferably threaded through one or more eyelets 52 rigidly attached to the bottom surface of the float members 34 which may advantageously be provided with a cylindrical insert sleeve 53 to prevent degradation caused by abrasion of the cable 50 against the concrete shell 58 of the float members 34. As will be recognized, these cables 50 flexibly interconnect adjacent float members 34 to form a composite linkage structure which permits relative movement between the members to accommodate wave or swell motion of the waterway 12. As mentioned previously, the cables 50 also form an anchor for the plates 38, through cables 35.

In the preferred embodiment, the support frame structure 20 is submerged to a depth of approximately 20 feet below water level and is aligned with the floating structure 18 such that the vertical riser 43 of the hub or spindle 42 resides within an aperture 33 formed in the platform 32, and the pipe members 40 are vertically registered beneath the pontoon segments 38. In this position, the flexible float structure 18 may be interconnected with the rigid frame 20 by a series of cables 62 or rigid links 64 which extend from the elongate floats 34 to the pipe members 40.

In the preferred embodiment, a pair of continuous length cables **62*a* and 62*b* which extend throughout the length of each of the radial members 30 (shown in FIG. 2) between the float members 34 and pipe members 40 are placed in tension to maintain the parallel orientation of adjacent float members 34 as well as the relative orientation between the floating structure 18 and the frame structure 20**.

As shown in FIG. 4, each of the cables **62*a* and 62*b* are threaded through a plurality of eyelets 66 and capstans 68 rigidly mounted on the pipe members 40 and float members 34 respectively, and extend in a shoelace fashion between the floats 34 and pipe member 40. In the preferred embodiment, each of the cables 62*a* and 62*b* interconnect opposite ends of adjacent float members 34 and are opposed to one another (i.e., connected to opposite ends along each individual float member 34) to form a U-shaped configuration which insures that the extreme ends of the float members 34 are maintained in their proper lateral position (i.e., positioned parallel to the axes of the pipe member 40**).

Figure 6:
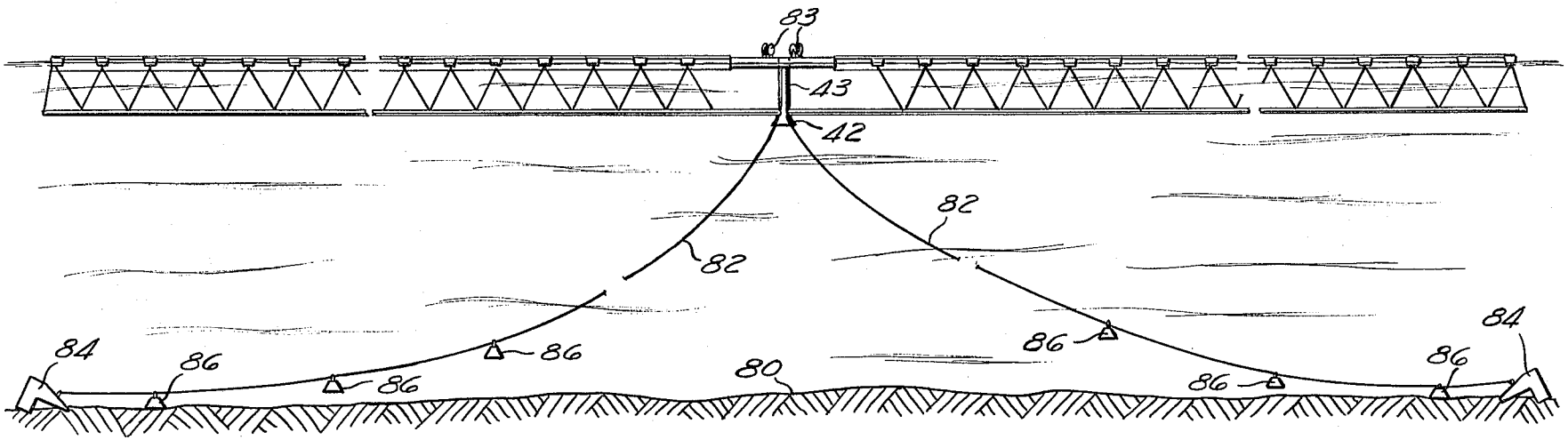
FIG. 6 is an elevation view of the floating marina of the present invention illustrating the manner in which the marina is anchored to the floor of the inland waterway.

It will be recognized that, with each float member 34 being provided with a pair of cables 62*a* and 62*b* adjacent each end thereof, the cables 62*a* and 62*b* form a criss-crossing pattern beneath the water surface as indicated in FIG. 6. Further, it should be noted that since the rigid frame 20 is submerged approximately twenty feet below the water level, this criss-crossing pattern does not interfere with boat access into the marina.

Alternatively, or in conjunction with the cables 62*a* and 62*b*, rigid link members 64 may be utilized to interconnect the flexible float structure 18 to the frame structure 20. As shown in FIGS. 4 and 5, the rigid links 64, preferably constructed to steel tubing, may be connected to the pipe member 40 by a tee clamp 65 or other conventional means and extend through an enlarged aperture 78 formed in the float members 34. Each of the apertures 78 preferably includes a sleeve 79 which reinforces the aperture 78 and prevents degradation caused by abrasion of the rigid link 64 against the concrete sheel 58 and foam core 60 of the float member 34.

In the preferred embodiment, the rigid link 64 additionally includes a biasing spring 69 surmounted about its diameter and disposed between a retainer ring 67 rigidly mounted to the link 64 and the lower surface of the float 34. This spring 69 places the link member 64 in substantial compression, yet permits minor vertical travel of the float member 34 relative the pipe member 40. As will be recognized, by selecting the spring 69 to possess a generally high spring rate, the rigid link 64 provides a substantially rigid interconnection between the floating structure 18 and the support frame 20.

From the above, it will be recognized that when both the cables 62*a* and 62*b* and rigid link members 64 are utilized, the rigid frame structure 20 is restrained from downward and lateral movement or deflection by the tension in the cables 62*a* and 62*b* whereas upward movement is eliminated by the rigid links 64.

Returning briefly to FIG. 1, and assuming that a strong wind is blowing from directly off shore (parallel to ramp 16), it will be seen that the floating structure 18 places a compressive load on pipe member 40*a*, and beam-type bending forces on pipe member 40*b*. As such, the support frame structure 20 is alternatively subjected to beam-type bending and column-type compressive loading. The applicant has found maximum beam loading occurs when minimum column loading exists, and conversely, maximum column loading occurs when minimum beam loading is present. This alternative loading allows the support frame 20 to be minimal in size yet adequately provide a rigid support for the marina. In addition, during column loading, the pipe members 40 are strengthened against buckling in a vertical plane by the cables 62 and rigid links 64, and in the horizontal plane by cables 44, 46, and 62. Thus, by the interconnecting cables 62*a* and 62*b* and/or links 64 of the floating structure 18, the marina 10 of the present invention provides a semi-rigid structure which possesses high structural integrity due to the strength being carried by the rigid frame 20 lying submerged beneath the surface of the waterway 12.

Referring now to FIG. 6, the anchoring of the marina 10 of the present invention to the floor 80 of the waterway 12 may be described. As better shown in FIG. 6, the center hub or spindle 42 of the support frame 20 includes a vertical riser 43 and is adapted to receive therein one or more main anchor lines 82 which extend downward toward the waterway floor 80. Each of these main anchor lines 82 is connected at one end thereof to a winch 83 located on the central platform 32 of the float structure 18 and to an anchor 84 at the other end thereof. In the preferred embodiment, the anchors 84 comprise large, variable buoyancy structures weighing approximately 80,000 pounds each.

As is well known in the art, the anchors 84 are typically set by being initially lowered vertically to contact the waterway bottom 80 and then subsequently dragged horizontally a short distance along the floor 80 of the waterway 12. This horizontal dragging causes the anchors 84 to bite or securely set themselves into the floor 80. By weighting the anchor cables, it will be noted that the anchor lines 82 extend in a horizontal direction as well as vertically toward the spindle 42, such that, as the floating structure 18 and frame 20 pulls against the main anchor lines 82, the anchors 84 will be initially urged horizontally along the floor of the waterway 80, thereby further embedding themselves therein.

In the preferred embodiment, three main anchor lines 82 are positioned symmetrically about the axis of the hub 42 (120-degree intervals) and extend radially outward substantially beyond the end of the floating structure 18. The applicant has found that these three main anchor lines 82 and anchors 84 provide a three-point anchor system which will allow only minor variances in the location of the marina in the waterway caused by minimal horizontal slack in the anchor lines 82.

Each of the main anchor lines 82 may additionally be provided with one or more mid-weights 86 which are rigidly attached intermediate its length. These mid-weights 86, which typically weigh substantially less than the main anchors 84 (approximately 10,000 pounds), cause the section of the anchor line lying between the upper-most mid-weight 86 and the hub 42 to assume a greater vertical orientation than the remainder of the anchor line 82 thereby alleviating the slack in the main anchor lines 82.

Thus, with the slack in the anchor lines 82 removed by use of the mid-weight 86, variances in the location of the marina 10 in the waterway 12 caused by moderate current or wind forces are reduced. Additionally, the mid-weights 86 provide a buffer mechanism which substantially reduces the vertical pull on the main anchors 84. As will be recognized, in the preferred embodiment wherein three mid-weights are utilized, a substantial mass of 30,000 pounds is additionally maintained on each of the anchor lines 82. This extensive weight serves as a preliminary anchor which absorbs or dissipates the majority of the short duration forces exerted on the lines 82. Thus, the main anchors 84 are subjected primarily to the main, long-term, horizontal forces which, as previously mentioned, tend to further set the anchors in the floor of the waterway.

By use of the three main anchor lines 82 which are preferably connected to the separate ratchet-winch mechanisms 83, it will be recognized that the entire marina 10 of the present invention may be laterally transported throughout a moderate distance in the waterway without the need of relocating the main anchors 84.

With the main anchor lines 84 being disposed at approximately 120-degree intervals and extending substantially beyond the extremities of the float structure as previously mentioned, a user may "take-in" or "reel-out" the separate anchor cables 82 from the three-winch mechanisms 83. By such a procedure, the float and frame structures 18 and 20 will be pulled together toward (or alternatively away from) a particular anchor location, moving about a line determined by the amount of cable released or retracted by the respective winch mechanisms 83. Further, as may be recognized, the position of the marina 10 may be continuously varied throughout an area in the waterway defined by the radial distance between the center of the marina and the position of the anchors 84, which, in the preferred embodiment, is approximately 600 feet. Thus, in most inland waterway applications, once the main anchors 84 are initially set in the waterway, the position of the marina 10 may be easily varied to accommodate changing water level and boundaries without the necessity of relocating the main anchors 84.

Thus, from the above, it is apparent that the marina 10 of the present invention provides an inherently strong structure due to the interconnection of the floating structure 18 with the submerged rigid frame 20. Additionally, by use of the three-point anchoring system, the marina 10 of the present invention may be accurately located at a desired position in a waterway and remain substantially stationary therein due to the main anchors and mid-weights attached to the main anchor lines 82.

As previously mentioned, in the preferred embodiment, the marina 10 of the present invention comprises an extremely large marina structure which is accurately maintained in a desired location in the waterway 12 by the use of only three large anchors set upon the floor of the waterway. Heretofore, prior art inland marinas formed in the size of the present invention often required the use of hundreds of anchors which, during the relocation process of the marina, had to be lifted and transported in unison.

As such, the present invention provides a significant improvement over the prior art in that in most inland waterways, the three main anchors need never to be repositioned in the waterway to relocate and transport the marina. However, even in those peculiar applications wherein the water level changes is so dramatic as to require substantial transport of the marina in the present invention only the three anchors need be simultaneously raised from the bottom of the waterway during the relocation and transport process. Additionally, since the three main anchors are preferably located radially outward from the floating marina 10, access to the anchors during the lifting process is significantly enhanced.

However, the present invention contemplates a further significant improvement over prior art inland marinas by providing variable buoyancy anchors 84 and mid-weights 86 which may be easily raised from the bottom of the waterway during the relocation process without the use of a crane or winch apparatus.

Figure 7:
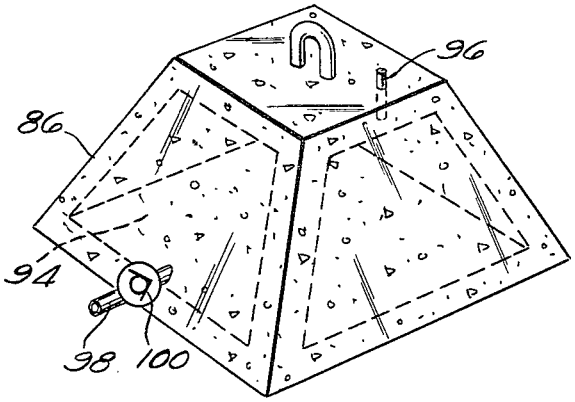
FIG. 7 is a perspective view of the mid-weight anchor of the present invention.
Figure 8:
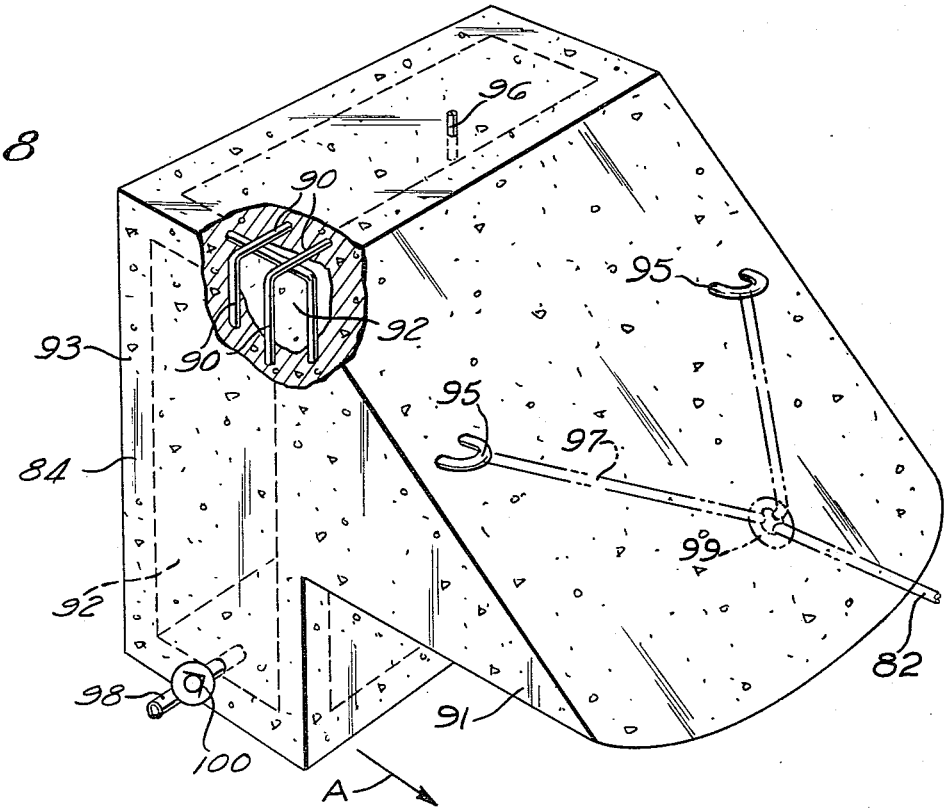
FIG. 8 is a perspective view of the buoyant anchor of the present invention.

Referring to FIGS. 8 and 7, respectively, the detailed construction of the variable buoyancy anchor 84 and mid-weight 86 is illustrated. As shown, the anchor 84 is preferably formed having a generally FIG. 4 cross-section (better shown in FIGS. 10 and 12), whereas the mid-weight 86 is formed in a truncated triangular configuration. To possess the substantial weight required to maintain the marina 10 stationary within the waterway, the anchor 84 and mid-weight 86 are preferably formed of concrete reinforced by a re-bar webbing 90 and include a central sealed cavity 92 and 94, respectively, extending substantially throughout the interior thereof.

Each of the cavities 92 and 94 are provided with a pair of access tubes 96 and 98 which extend through the exterior walls of the anchor 84 and mid-weight 86 and are located at opposite ends of the cavities. Each of the lower tubes 98 are additionally provided with a check valve 100 which serves as a pressure equalizer for the interior cavities 92 and 94, respectively.

Thus, with the structure defined, the operation of the variable buoyancy anchor and mid-weight 84 and 86, respectively, of the present invention may be described. As shall be recognized, due to the anchor 84 and mid-weight 86 being provided with the enlarged cavities 92 and 94, respectively, the buoyancy of the anchor and mid-weight may be varied by the selective introduction of air into the cavities 92 and 94.

In particular, during the lowering of the anchor 84 and mid-weight 86 beneath the water surface, water is introduced through the access tubes 96 to begin filling the interior cavities 92 and 94. As the quantity of air contained within the cavity is displaced by the incoming water, the weight of the concrete structure will overcome the buoyant force produced by the air contained within the cavity, thereby allowing the anchor or mid-weight to travel downward or sink below the surface of the water. When all the air contained within the cavity is dispelled through the access tube 96, the anchor and mid-weight 84 and 86 will have zero buoyancy and have an effective anchoring weight equal to the actual weight of the cement casings.

However, unlike the prior art anchors, the anchor 84 and mid-weight 86 of the present invention may be floated upward from the bottom of the waterway simply by introducing air into the interior of the cavities 92 and 94. In the preferred embodiment, this air is introduced into the interior of the cavities 92 and 94 by simply connecting a hose or air line (not shown) to the access tubes 96 of the anchors 84 and mid-weight 86 and pumping air from above the surface of the water directly into the cavities 92 and 94.

During this pumping process, the water contained within the cavities 92 and 94 is displaced through the lower access tube 98 and check valve 100. When the weight of the water displaced from the cavity 92 or 94 is greater than the weight of the concrete structure of the anchor 84 or mid-weight 86, the buoyancy produced by the air contained within the cavity will cause the anchor or mid-weight to gradually rise towards the surface of the water.

During this upward movement of the anchor from the bottom of the waterway, the check valve 100 located upon the lower access tubes 98, serves as a pressure equalizer, allowing air to be discharged from cavities 92 or 94 as a function of the submersion depth of the anchor or mid-weight below the water surface. (For example, as the anchor rises toward the waterway surface, the water pressure exerted against the anchor linearly decreases. When the water pressure on the exterior of the anchor is less than the air pressure within the cavity, the check valve 100 opens, allowing air to be vented into the waterway.) Thus, it will be recognized that the air pressure within the cavity of the anchor and mid-weight 84 and 86, respectively, will continuously decrease upon the upward travel toward the water surface insuring against excessive pressure being developed within the cavity of the anchor or mid-weight which, in extreme instances, could cause the anchor to rupture or explode.

Thus, due to the variable buoyancy anchor 84 and mid-weight 86 of the present invention, the relocation process of the inland marina 10 may be easily facilitated without the requirement of using a plurality of winch or crane apparatus to lift the weights from the floor of the waterway. Rather, by use of the variable buoyancy anchors and mid-weight of the present invention, a small boat having an auxiliary air compressor contained on board, may be utilized to pump air into the cavities of the anchor 84 and mid-weight 86. After a short pumping period, the anchor and mid-weight rise to the surface of the waterway, wherein a single towing vessel (not shown) may be utilized to pull the rigid support frame 20 to the desired location upon the waterway.

Subsequently, the air lines may be removed from the access tubes 96, and water again introduced into the interior cavities 92 and 94, respectively, causing the anchor 84 and mid-weight 86 to submerge below the surface of the waterway.

Although the particular configuration of the anchors 84 and mid-weight 86 should not be viewed as a limitation of the scope of the invention, the particular configurations depicted in FIGS. 7 and 8 have been found to be extremely suitable for the large floating marina structure 10 of the present invention. As shown, the anchor 84 includes a triangular body portion 91 which juts out or extends from the main rectangular section 93 of the anchor 84. This triangular section is preferably provided with a pair of eyelets 95 rigidly attached thereto, which receive a short length of cable 97. The main anchor line 82 is connected to the cable 97 by a ring mount 99 which allows the anchor line 82 to slide along the length of the cable 97 between the span of the eyelets 95.

During the setting of the anchor 84 in the manner previously described, the anchor 84 is initially oriented along the floor of the waterway in the position shown in FIG. 8 (i.e., with the bottom surface of the rectangular section 93 resting on the waterway floor and the triangular portion 91 facing toward the hub or center of the marina 10).

Subsequently, the anchor 84 is dragged horizontally (in the direction of the arrow A in FIG. 8) along the floor of the waterway, whereby the anchor pivots in a clockwise direction about the leading edge 101 of the rectangular section 93, causing the front edge of the triangular section 91 to contact the waterway floor. Continued horizontal dragging causes the triangular section 91 to be embedded or dig deeply into the floor of the waterway, whereby the anchor 84 is firmly set. It will be recognized that the eyelets 95 are preferably positioned far enough from the leading edge of the triangular section 91 to allow the leading edge to pivot downward into the waterway floor, yet are located close enough thereto to prohibit excessive clockwise rotation or pivoting which would cause the anchor 84 to turn over upon itself during the dragging procedure. As such, the particular configuration of the anchor 84 facilitates the proper setting of the anchor 84 along the bottom of the waterway.

Due to the substantial size of the anchor 84 and mid-weight 86 (in the preferred embodiment, the anchor weighs approximately 80,000 pounds and has a central enlarged cavity of approximately 1,500 cubic feet, whereas the mid-weight weighs approximately 10,000 pounds and has a cavity size of 200 cubic feet), the present invention contemplates an in-situ method for constructing and transporting the anchor 84 and mid-weight 86 into the waterway.

Referring to FIGS. 9–12, the details of this in-situ method for constructing and transporting of the anchor 84 and mid-weight 86 may be described. In the preferred embodiment, a large excavation 102 is formed adjacent the shoreline 104 and extends to a depth beneath the water level 106. To eliminate substantial quantities of water seeping from the waterway into the excavation 102, the excavation typically is positioned at least 25 feet from the shoreline. Additionally, any minor amount of seepage is preferably removed from the excavation by a pump 108 having an intake line 109 which extends adjacent the lower surface of the excavation 102. Shoring members 110 may then be inserted on the bottom and side surfaces of the excavation 102 and maintained in position by one or more support rods 112 which extend between adjacent shoring members 110.

With the excavation 102 formed adjacent the shoreline 104, the anchor 84 may then be constructed in any of the well-known concrete forming methods (one of such methods being illustrated in FIGS. 10–12). Subsequently, the vertical shoring members 110 are removed from the excavation, as well as their support rods 112, and a trench 114 having a width equal to or greater than that of the excavation 102, is dug between the waterway 12 and the excavation 102. This trench allows the waterway 12 to flood the excavation 102, whereby, due to the buoyancy of the anchor 84, the anchor 84 may be towed by a boat (not shown) out of the excavation 102 and through the trench 114 to its desired location in the waterway 12. Once at its proper location, the anchor 84 may be filled with water, causing the anchor to submerge to the floor of the waterway.

As will be recognized, this in-situ method of forming and transporting the anchor 84 of the present invention eliminates the need for using large crane or winch apparatus to position the anchor in the waterway 12, and additionally permits the anchors 84 to be formed in the immediate area of the marina 10 of the present invention. As such, construction and transportation costs of the large anchors 84 are significantly reduced.

Further, in those particular instances where a substantial number of anchors 84 are to be formed, the vertical shoring members 110 located nearest the shoreline 104 may be replaced by a water gate (not shown) which may be selectively opened and closed to flood the excavation 102. By use of a water gate, the excavation 102 may be re-used for subsequent anchor casting procedures. The applicant has found that this same in-situ construction method may be used for the formation of the mid-weights 86 (shown in FIG. 8) as well as the elongate floating members 34 (shown in FIG. 2).

Referring now to FIGS. 10–12, the preferred construction method of forming the variable buoyancy anchors 84 of the present invention is illustrated. Although, for illustration purposes, the shoring members 110 and excavation 102 have been removed from FIGS. 10–12, it should be recognized that the formation process illustrated occurs within the excavation 102 of FIG. 9.

The initial step of the formation of the anchor 84 of the present invention is shown in FIG. 10 wherein a bottom plate member 120 is formed in a substantially planar figure four (4) shape. As shown, casting forms 122, preferably fabricated from cast aluminum or plywood sheet material, are placed along the bottom of the excavation 102 and oriented to provide the desired configuration.

A steel reinforcement webbing (re-bar) 124 may be placed within the interior of the forms and positioned to extend substantially above the top edge of the forms 122. As will become more apparent infra, this vertical extension of the re-bar 124 facilitates a strong structural bond between the bottom plate member 120 and the side walls 134 of the anchor 84 (as depicted in FIG. 11). Subsequently, with the re-bar 124 positioned within the forms 122, concrete 126 may be poured into the form and allowed to cure.

With the lower plate 120 disposed along the bottom floor of the excavation 102, forms 122 may be extended in a vertical direction as shown in FIG. 11 to accommodate the pouring of the side walls 134 of the anchor 84. In this second formation step, an interior rectangular form having dimensions less than that of the exterior forms 122, is positioned concentric with the rectangular section of the outer forms 122 against the plate member 120 to form a casting channel 132. A reinforcement web 124 may then be inserted into the channel 132 formed between forms 122 and 128, and the channel 132 is subsequently filled with concrete. By such a procedure, it will be recognized that the side walls 134 of the anchor 84 are secured to the bottom plate 120 by the re-bar webbing which extends from the bottom plate 120 into the side walls 134.

The final forming step of the anchor 84 of the present invention is accomplished by the pouring of the top panel 136 on the side walls 134 as shown in FIG. 12. In the preferred embodiment, the interior forms 128 which were used to form the side walls 134 of the anchor 84, are permanently left within the interior of the cavity 92 and may be utilized to support a top cover 138 which extends over the cavity 92. As will be recognized, this top plate 138 prevents cement from flowing into the cavity 92 during the pouring of the top plate 136 of the anchor 84.

With the top plate 138 positioned over the cavity 92, the re-bar webbing 124 is placed within the forms and concrete is poured in a manner previously described, whereby the top plate 136 is permanently joined to the side panels 134.

Thus, from the above, it may be seen that, by constructing the variable buoyancy anchor 84 of the present invention by the in-situ method disclosed herein, standard concrete forming procedures may be utilized which significantly reduce construction costs. Further, it will be recognized that, since the curing of concrete is enhanced by exposure to water, the anchor 84 as constructed in the manner previously described, may be utilized while the concrete is still somewhat green (or curing) and may permanently cure while submerged in the waterway. Additionally, although the dry joint interfaces formed on the anchor 84 may permit some seepage of water into the interior cavity 92, the applicant has determined that such seepage is minimal and may be easily displaced from the cavity 92 by air forced into the cavity 92 during the anchor raising process.

As an explanatory note, it should be recognized that the marina 10 of the present invention also readily lends itself to initial launching into the waterway. In the preferred embodiment each of the arm or pipe members 40 of the rigid support frame 20 may be constructed on land adjacent the marina site in a segmented manner wherein a plurality of pipe lengths are welded together in an end-to-end orientation. Opposite ends of the pipe members 40 may then be capped to form an air tight pipe segment which will float upon the waterway.

Subsequently each of the pipe members 40 may be towed from the land into the waterway by a small boat wherein they may be positioned and welded to the central hub 42. The perimeter ties 44 may then be connected to each of the arm members 40 to form the rigid frame structure 20.

With the frame structure 20 positioned in a desired location within the waterway, water may be introduced into each of the arm members 40 through vent apertures (not shown) thereby providing a neutrally buoyant structure which may be easily submerged and maintained at a desired depth below the water surface by one or more towing lines extending to the towing vessel during marina installation.

Subsequently, the three main anchors 84 and midweights 86 may be floated along the surface of the waterway in a manner previously described and attached to the central hub 42 of the frame structure 20 by the three main anchor lines 82. The anchors 84 and midweights 86 may then be flooded with water and submerged beneath the waterway 4 whereby the positioning of the rigid frame structure 20 is maintained.

The elongate float members 34 may subsequently be towed individually on the surface of the waterway to the desired location relative the rigid support frame 20, and connected to the rigid support frame 20 by mooring cables 62 and rigid links 64. As will be recognized, this procedure may be repeated for each elongate float member 34 until the entire marina 10 is formed. Subsequently the plate members 38 may be placed upon the floating members 34 and the frame structure 20 may be completely flooded through the vent apertures as previously mentioned whereby the neutral buoyancy of the frame structure 20 is eliminated.

Further, in addition to the main anchor lines extending from the central hub of the support structure 20, the applicant has found it advantageous to connect a pair of mooring lines (not shown) to one of the pipe members 40 which extend to the floor of the waterway in a tangential orientation to the marina 10. These mooring lines prevent any rotation of the marina about the center hub and in conjunction with the main anchor lines positively maintain the desired location and orientation of the marina 10 within the waterway.

Additionally, it will be recognized that although for illustration purposes, a single floating marina 10 has been described in the specification, multiple marina structures formed in the manner of the present invention may be ganged or connected to one another, with ramps interconnecting adjacent float structures along one of the walkways, thereby facilitating an extremely vast marina complex.

I claim:

1. A floating marina for use on a body of water comprising:

plural independent float members adapted to float on the surface of said water;

means for flexibly interconnecting said float members to permit limited movement between adjacent float members to facilitate the absorption of minor wave forces, said float members forming at least one boat docking slip;

a support structure submerged within said body of water, said support structure possessing structural integrity sufficient to maintain the position and orientation of said structure relative to said body of water; and means connected between said float members and said support structure for suspending said support structure beneath said float members at a predetermined depth, above the bottom of said body of water, said suspending means further serving to define the positions of said float members.

2. A floating marina according to claim 1, wherein said support structure is suspended beneath said float members at a predetermined depth which is generally slightly greater than the maximum draft of boats to be docked in said marina.

3. A floating marina according to claim 1, further comprising:

a central floating platform, said float members surrounding said central platform, said interconnecting means flexibly interconnecting said float members with said central platform to form a unitary, interconnected floating structure.

4. A floating marina according to claim 3, wherein said support structure comprises:

a plurality of structural members commonly connected at one end thereof to a central hub and extending radially outwardly therefrom.

5. A floating marina according to claim 4, further comprising:

means for interconnecting said central hub and said central floating platform.

6. A floating marina according to claim 5, wherein said central hub and said central floating platform are interconnected in vertically registered positions.

7. A floating marina according to claim 6, wherein said means for flexibly interconnecting said floating members extend generally radially outwardly from said central platform to define a series of radial arms and wherein said float members are arranged in a mutually parallel orientation, normal to said radial arms.

8. A floating marina according to claim 7, wherein the position and length of each of said structural members corresponds to that of said radial arms of said unitary floating structure to facilitate interconnections therebetween.

9. A floating marina according to claim 8, wherein said flexible interconnecting means comprises:

a plurality of cables, one end of each of said cables being connected to said central platform, said cables extending along the bottom surfaces of said float members in a single radial direction and being flexibly connected thereto, the other ends of said cables being connected to the other ends of adjacent support members.

10. A floating marina according to claim 5, further comprising:

a plurality of anchor cables, first ends of said cables being connected to said central hub and said central floating platform, the other ends of said cables being connected to anchors adapted to be positioned on said bottom of said body of water in spaced relationship around said central platform.

11. A floating marina according to claim 10, wherein said first ends of said cables are connected to individual mechanisms mounted on said central platform for controlling the lengths of said cables so as to permit limited movement of said floating structure relative to said bottom of said body of water.

12. A floating marina according to claim 10 or 11, wherein there are at least three anchor cables positioned symmetrically about the axis of said central hub and extending radially outwardly therefrom beyond the end of said floating structure.

13. A floating marina according to claim 10 or 11, further comprising:

a plurality of mid-weights positioned on each of said anchor cables, intermediate the opposite ends thereof.

14. A floating marina according to claim 3, wherein said flexible interconnecting means comprises:

plural plate members extending between adjacent float members and supported thereby, said plate members not being rigidly connected to said float members; and cable means for maintaining the orientation of said float members and said plate members.

15. A floating marina according to claim 1, wherein said support structure comprises:

a plurality of structural members commonly connected at one end thereof to a central hub and extending radially, outwardly therefrom.

16. A floating marina according to claim 15, wherein each of said structural members comprises a tubular member sealed at both ends thereof to provide a neutral buoyancy structure.

17. A floating marina according to claim 15, wherein said support structure further comprises:

a tension cable connected between the other ends of said structural members to form a perimeter tie.

18. A floating marina according to claim 17, wherein said support structure further comprises:

at least one intermediate cable connected between adjacent structural members, intermediate the opposite ends thereof, to provide intermediate support.

19. A floating marina according to claim 1, wherein said suspending means comprises:

at least one cable extending between said float members and said support structure for supporting said support structure above the bottom of said body of water and for suspendng said support structure at said predetermined depth, said cable exerting a force on said float members to maintain the positions thereof.

20. A floating marina according to claim 19, wherein said suspending means further comprises:

at least one rigid member extending between said float members and said support structure, said rigid member preventing said support structure from moving towards said float members.

21. A floating marina according to claim 20, wherein said cable exerts a bending force on said support structure and said rigid member exerts a compressive force on said support structure, said bending force being a maximum when said compressive force is a minimum.

* * * * *